US006273424B1

(12) United States Patent
Breeding

(10) Patent No.: US 6,273,424 B1
(45) **Date of Patent: *Aug. 14, 2001**

(54) BET WITHDRAWAL CASINO GAME AND APPARATUS

(76) Inventor: John G. Breeding, 370 Rockridge Dr., Sedona, AZ (US) 86336

( * ) Notice: Subject to any disclaimer, the term of this patent is extended or adjusted under 35 U.S.C. 154(b) by 0 days.

This patent is subject to a terminal disclaimer.

(21) Appl. No.: 09/317,705

(22) Filed: May 24, 1999

Related U.S. Application Data

(63) Continuation-in-part of application No. 08/970,966, filed on Nov. 14, 1997, which is a continuation-in-part of application No. 08/198,368, filed on Feb. 18, 1994, now Pat. No. 5,437,462, which is a continuation of application No. 08/023,196, filed on Feb. 5, 1993, now Pat. No. 5,288,081.

(51) Int. Cl.[7] ..... A63F 1/00

(52) U.S. Cl. ..... 273/292; 273/274; 273/309; 273/85 CP

(58) Field of Search ..... 273/236, 292, 273/138.2, 138 A, 138 R, 309; 463/20, 26

(56) References Cited

U.S. PATENT DOCUMENTS

| | | | |
|---|---|---|---|
| 3,876,208 | 4/1975 | Wachtler et al. | 273/138 |
| 3,939,953 | 2/1976 | Miyazawa | 194/100 |
| 4,305,586 | 12/1981 | Richards | 273/274 |

(List continued on next page.)

FOREIGN PATENT DOCUMENTS 0443420 8/1991 (EP) .

OTHER PUBLICATIONS

"Declaration of Jim Kilby Under 37 CFR 1.132", 2 pages, (May 9, 1995).

"Over/Under 13 Blackjack", Product Brochure published by Gaming Concepts, Inc., 3 pgs., (1988).

(List continued on next page.)

*Primary Examiner*—Steven Wong
*Assistant Examiner*—Dolores Collins
(74) *Attorney, Agent, or Firm*—Mark A. Litman & Assoc. P.A.

(57) ABSTRACT

A method of playing a wagering game, such as a casino table game or video game, including a playing card wagering game method involves each player placing a multiple part bet, such as a two, a three or a four part bet. A certain position in the order of play is reached (such as with cards being dealt by the dealer, two face down to the dealer and three face down to each player), and the player is given an opportunity to withdraw at least one part of the multiple part bet from risk, although at least one part of the multiple part bet must remain at risk during the play of the game. Players inspect or "sweat" the value of their position in the game (such as evaluating their cards) and the dealer or the program for the game gives each player the choice of withdrawing or leaving a first part of the bet. Each player decides and the dealer or the software then allows the game to advance (e.g., the dealer then turns over one of the cards. Where there are more than two parts to the multiple part bets, the dealer or apparatus may again give each player the choice of withdrawing or leaving a second part of the bet. The players decide and the game may continue, with or without a repetition of potential withdrawal of another part, but less than all parts of the multiple parts of the bet. For example in a card game, the player's cards are shown, and all remaining bets, which were not withdrawn, are resolved.

48 Claims, 3 Drawing Sheets

U.S. PATENT DOCUMENTS

| | | | | |
|---|---|---|---|---|
| 4,593,904 | | 6/1986 | Graves | 273/1 |
| 4,651,997 | | 3/1987 | Wood | 273/274 |
| 4,652,998 | | 3/1987 | Koza et al. | 364/412 |
| 4,659,087 | | 4/1987 | Shen et al. | 273/274 |
| 4,743,022 | | 5/1988 | Wood | 273/85 CP |
| 4,756,531 | | 7/1988 | DiRe et al. | 273/138 |
| 4,836,546 | | 6/1989 | DiRe et al. | 273/138 |
| 4,836,553 | | 6/1989 | Suttle et al. | 273/292 |
| 4,837,728 | | 6/1989 | Barrie et al. | 364/412 |
| 4,842,276 | | 6/1989 | Darby | 273/1 |
| 4,861,041 | | 8/1989 | Jones et al. | 273/292 |
| 4,882,473 | | 11/1989 | Bergeron et al. | 235/380 |
| 4,906,005 | | 3/1990 | Manabe | 273/142 |
| 4,948,134 | | 8/1990 | Suttle et al. | 273/85 |
| 5,019,973 | | 5/1991 | Wilcox et al. | 364/412 |
| 5,022,653 | | 6/1991 | Suttle et al. | 273/85 CP |
| 5,042,635 | | 8/1991 | Bell | 194/346 |
| 5,042,818 | | 8/1991 | Weingardt | 273/292 |
| 5,078,405 | | 1/1992 | Jones et al. | 273/309 |
| 5,098,107 | | 3/1992 | Boylan et al. | 273/292 |
| 5,100,137 | | 3/1992 | Fulton | 273/85 |
| 5,112,060 | | 5/1992 | Jones | 273/309 |
| 5,114,155 | | 5/1992 | Tillery et al. | 273/371 |
| 5,116,055 | | 5/1992 | Tracy | 273/138 |
| 5,167,413 | | 12/1992 | Fulton | 273/85 |
| 5,248,142 | * | 9/1993 | Breeding | 273/138 R |
| 5,275,400 | | 1/1994 | Weingardt et al. | 273/85 |
| 5,275,415 | | 1/1994 | Wisted | 273/274 |
| 5,288,077 | | 2/1994 | Jones | 273/292 |
| 5,288,081 | * | 2/1994 | Breeding | 273/292 |
| 5,326,104 | * | 7/1994 | Pease et al. | 273/138 A |
| 5,364,104 | | 11/1994 | Jones et al. | 273/292 |
| 5,382,025 | | 1/1995 | Sklansky et al. | 273/292 |
| 5,393,067 | | 2/1995 | Paulsen et al. | 272/292 |
| 5,417,430 | * | 5/1995 | Breeding | 273/292 |
| 5,437,462 | * | 8/1995 | Breeding | 273/292 |
| 5,472,194 | | 12/1995 | Breeding et al. | 273/138 |
| 5,544,892 | * | 8/1996 | Breeding | 273/292 |
| 5,630,586 | * | 5/1997 | Lowden | 273/138.2 |
| 5,669,817 | * | 9/1997 | Tarantino | 463/13 |
| 5,743,800 | * | 4/1998 | Huard et al. | 463/26 |
| 5,769,422 | | 6/1998 | Stromer | 273/274 |
| 5,848,932 | | 12/1998 | Adams | 663/20 |
| 5,851,011 | * | 12/1998 | Lott | 273/292 |
| 5,901,958 | * | 5/1999 | Andrews | 273/292 |
| 5,957,459 | * | 9/1999 | Chae | 273/292 |
| 5,979,897 | * | 11/1999 | Grossman | 273/292 |
| 5,984,309 | * | 11/1999 | Santin | 273/292 |
| 5,984,310 | * | 11/1999 | English | 273/292 |
| 5,988,643 | * | 11/1999 | Awada | 273/292 |
| 6,012,719 | * | 1/2000 | Webb | 273/292 |
| 6,019,374 | * | 2/2000 | Breeding | 273/292 |
| 6,036,190 | * | 3/2000 | Edmunds et al. | 273/292 |

OTHER PUBLICATIONS

"Second Amended Petition filed in the Civil Action "In the Matter of the Petition of IGT for Certain Declaratory Rulings and for the Authorization f for the Implementation of the Game of Progressive–21"., pp. 1–9, (1992).

"Wheel of Gold", Product Information published by Anchor Games, 11 pages, (Oct. 1995).

"Wild Deuces", *Michigan Legionnaire*, vol. XXXII, No. 10, 1 page, (Oct. 1978).

Gros, R., "Working Within the Systems", *Casino Journal*, vol. 8, No. 12, pp. 10–11, 13, 15, 4, (Dec. 1992).

Scarne, J., "Carne's Encyclopedia of Games", *Harper & Row Publishers*, First Edition, pp. 36–41, 288, 299–, (1973).

Smith, C., "Bar Bosses See New Trivia Game Filling More Seats", *The Vancouver Sun*, 1 page, (Feb. 21, 1990).

Scarne, Jr., "Scarne's Encyclopedia of Games", *Harper & Row Publishers, First Edition*, "Pontoon", p. 288, "Scarney Baccarat"®, pp. 299–304, and "Three–In–One", p. 383.

Scarne, Jr., "Scarne's Encyclopedia of Games", *Harper & Row Publishers, First Edition*, pp. 33–41, 1973.

J. Scarne, "Scarne's Guide to Modern Poker", Constable and Company Limited, 1979, "Pokino", pp. 160–162.

* cited by examiner

BET WITHDRAWAL CASINO GAME AND APPARATUS

RELATED APPLICATIONS

This Application is a continuation-in-part of U.S. patent application Ser. No. 08/970,966 filed on Nov. 14, 1997. That Application is, in turn, a continuation-in-part of U.S. patent application Ser. No. 08/198,368, filed Feb. 18, 1994 which has issued as U.S. Pat. No. 5,437,462, which was in-turn a continuation of U.S. patent application Ser. No. 08/023,196, filed on Feb. 5, 1993, which has issued as U.S. Pat. No. 5,288,081.

BACKGROUND OF THE INVENTION

1. Field of the Invention

The present invention relates to a method of playing a wagering game with any gaming format (e.g., cards, dice, symbols, table games and video games), such as playing card wagering games that can be played with a standard deck of cards or by video machine technology in a casino or home environment. In particular, it relates to a method and apparatus for playing a wagering game and provides players the opportunity to take or leave a portion of their wager during the course of the game. A preferred game is a variation of poker such as a variant of five card stud poker.

2. Background of the Art

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

The desired attributes of wagering games outlined above are in large measure provided by the method and apparatus for playing a wagering game in accordance with the present invention. The game is uncomplicated, exciting and provides the opportunity for players to make multiple wagers and choices regarding those wagers.

SUMMARY OF THE INVENTION

The wagering game of the present invention may be played with any convenient, traditional or non-traditional gaming format or gaming elements. For the purposes of this disclosure, "Game elements" or "gaming elements" means information used by a player or dealer to participate in the game such as the face value of cards, the face value of a die or dice, slot symbols, angular positions on a wheel or reel game, cards (e.g., from a standard or non-standard playing deck), symbols on a reel, dice, tiles or the like. A preferred medium of play is with a single, typical (standard) fifty-two card poker deck (with or without jokers, or with cards removed as with Spanish Twenty-One™ where tens are removed from the deck and other rules are instituted) and a specific preferred game broadly involves the generally well recognized and accepted set of rules, procedures and wager-resolving outcomes of five card poker. The game method comprises each player placing an initial, multi-part wager, such as a two-part, three-part, four-part, or more-part wager to participate in the game. The game is initiated such as with dice being rolled (some or all of the dice in a bar game, for example) or cards are dealt by a dealer. In a preferred game, a dealer deals three player's cards face down to each player and two community cards face down to the dealer. Players inspect or "sweat" their cards, and the dealer asks "take it or leave it?" with regard to the first part of the initial bet. Players can choose to retrieve or remove from play the first part of their initial bet, or leave the first part in play or at risk, based on the value of the three cards in their hand. The dealer then turns over one of the dealer's community cards and the dealer's query is repeated with regard to the second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet. Finally, all cards are shown and the payouts and collections are resolved according to the ranking of the poker hand of each player, i.e., the players are not playing against each other or the dealer. This widely played game is known as Let It Ride® stud poker.

More specifically, the initial wager placed by each player comprises three equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five card hand. After all players have placed their bets and received and examined their cards, each is given the opportunity to retrieve one-third of the initial wager before the dealer reveals one of the two down cards previously placed in front of him. After all of the players have been queried and decided whether to "take it or leave it", the dealer turns one of the down cards face up. Each player now has the benefit of knowing the identity of four cards, the three he or she is holding down plus the common card, and the dealer again gives each player the opportunity to retrieve one-third of the beginning wager before exposing the second common down card. After the second common down card is revealed, the players turn up the three cards they are holding thereby forming five card hands made up of the three cards dealt to each player and the two dealer cards. The dealer examines each of the players hands and determines what payout, if any, each player is entitled to receive according to that players' remaining wager and a preselected payout schedule. Payouts are made to players with winning hands and the losing wagers are collected. The cards are then reshuffled for the next hand.

A variation of this partial bet withdrawal method may be played with dice, where separate bet parts are associated with the roll of each die. For example, where a standard die with 1, 2, 3, 4, 5 and 6 dots on each face is used in Bar Dice, a separate bet may be associated with one or more of the individual dice. As each die stops turning or bouncing on a surface (in a real or virtual sense), or as each die is rolled and stops, the player may elect to withdraw one bet associated with that die or an adjacent die. Particularly where a dealer's dice hand is already shown or is partially shown, a player may reconsider the likelihood of a win, and determine whether or not all of his bet parts should remain in play. It should be noted that the play of the game involves distinct bet parts in its preferred play, as opposed to a Surrender play in Twenty-One, where half of the original bet is surrendered and half the bet is withdrawn, with no continuation of the play of the game. In the partial bet withdrawal method, the play of the game continues, with the potential for a player to win payouts on any bets remaining at the resolution of the game.

Apparatus is disclosed for playing the wagering game according to the method outlined above. A typical gaming table, with a playing surface, is modified to include specific areas that provide locations for placing the wagers and for displaying the common cards. A card shuffling machine such as that disclosed in U.S. Pat. No. 4,807,884 (invented by the inventor of the present invention and commonly owned) for facilitating and speeding the play of the wagering game may be used. A display device may be associated with the apparatus for displaying game information, such as common cards or pay tables, for example.

U.S. Pat. No. 5,437,462 describes a method of playing a wagering card game using actual or representations of standard face playing cards having a standard rank, said game involving standard poker hand rankings and comprising the steps of:

a player placing a wager to participate in the game;

providing cards for the player;

giving the player the chance to examine the cards received by the player and to withdraw at least part of said wager based on the rank of the player's cards;

showing the player at least one common card, thereby providing a hand for the player, the player's hand comprising said shown at least one common card and the cards the player received; and resolving the player's remaining wager, which was not withdrawn, based on the rank of the player's hand.

It is one aspect of the present invention to provide an exciting and interesting wagering game. Another aspect of the present invention is to provide a wagering game that is easy to learn, largely being based on five card stud poker and the well known ranking of poker hands. It is another aspect of the present invention to provide a new variation of a well known wagering game, five card poker, which is made interesting by providing the opportunity for players to make multiple wagers and decisions related to those wagers based on the progress of the game. Still another aspect of the present invention is to provide a wagering game that is easy to learn, yet demands skill of players in making strategic decisions about whether to let part of their bet remain at risk.

It is yet another aspect of the present invention to provide a unique, exciting card game for play in casinos or at home and on various media including casino tables, video poker machines, video lottery terminals or home computers.

It is an advantage of the game of the present invention that wagering decisions are inherent in the game. The game enhances players' sense of participation and takes advantage of players' inclination to let wagers remain at risk once placed. The game of the present invention advantageously creates a greater sense of control on the part of players, possibly resulting in the players wagerings more money per hand.

DETAILED DESCRIPTION OF THE INVENTION

A method of playing a wagering game comprises a player placing a wager comprising at least two distinct parts and providing to the player at least a portion of game elements so that a partial evaluation of the player's game outcome in at least a single game is provided, giving the player at least one opportunity, before the player's final game outcome is determined, to withdraw from engagement in the game at least one part of said at least two parts, but less than all of said at least two parts, and continuing play of the game with additional portions of the player's game outcome being revealed to the player.

Another method of playing a wagering game comprises a player placing a wager comprising at least two distinct parts and providing to the player a view of at least a portion of game elements in a dealer's hand so that a partial evaluation of the player's potential for winning against the dealer's hand in at least a single game is provided, giving the player at least one opportunity, before the display of all of the player's and/or the dealer's final game outcome (rank or value of the dealer's hand) is determined or displayed, to withdraw from engagement in the game at least one part of said at least two parts, but less than all of said at least two parts, and continuing play of the game to a resolution of remaining wagers.

The method may comprise a casino table card game, a video table game, a video card game, an electromechanical or video reel slot game, a video or live dice game, or a wheel game (such as roulette). The card game may comprise a poker game, a blackjack game, or other card game. Awards may be made for predetermined ranks of hands in the card game. Awards may be made for a player having a higher ranked hand than a dealer in the card game. Each of said at least two parts of said wager may be equal or any two or more may be unequal, and the number of at least two parts may be two, three, four, five six or more parts. The method may include the at least two-part wager, such as an initial three-part wager amount, wagered by each participating player comprising three equal parts and may be wagered before any cards are dealt, dice are thrown, or wheel or reel is spun.

Figure 1:
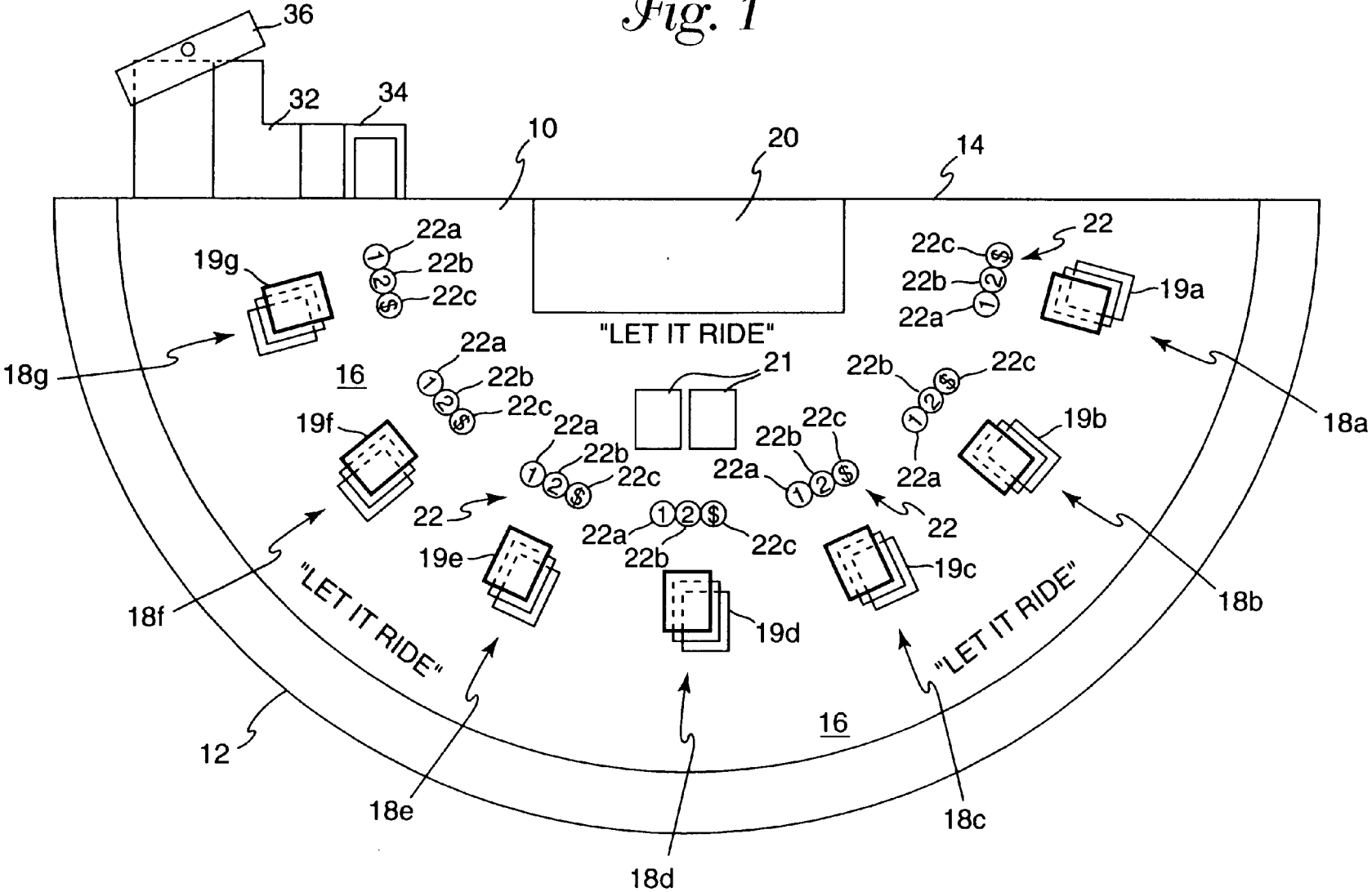
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 12 for accommodating up to seven players and a straight side 14 for accommodating the dealer. The table 10 has a flat playing surface 16 covered with felt or other appropriate material. Although seven playing positions or locations 18*a–g* for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20, including an area suitable for displaying the dealer's cards 21, is provided.

Each of the playing positions 18*a–g* includes a wagering zone 22, comprising three separate and distinct wagering or betting areas 22*a, b, c*. Each position 18*a–g* also includes a card area 19*a–g* for receiving and displaying cards dealt to the player occupying the position. The wagering areas 22*a, b, c* are designed to receive appropriate wagering indicators or settling means such as chips (not shown).

At one side of the dealer station 20, the apparatus for practicing the method of the present invention may include a microprocessor or computer controlled shuffling machine 32 supported by a table extension 34. The shuffling machine 32 may be of the type disclosed in U.S. Pat. No. 4,807,884, the disclosure of which patent is incorporated herein by reference. The shuffling machine 32 may include a dealing module for automatically and sequentially dealing cards and also may include a display means for displaying wager amounts, the identity of winning players, or other game related information.

Figure 2:
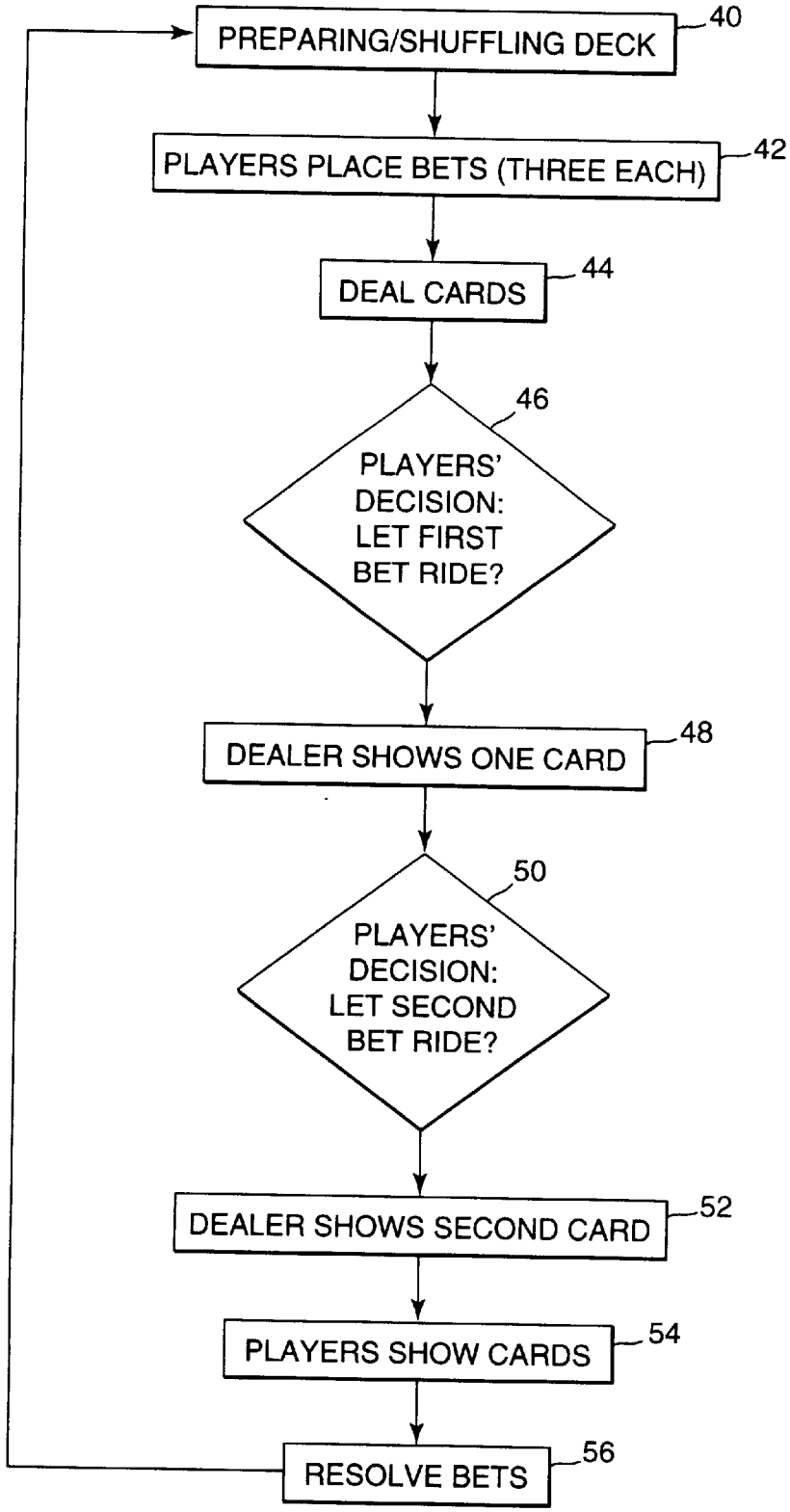
FIG. 2 is a block diagram representing the flow of play in the game.

Referring to the flow diagram of FIG. 2, the initial step in playing the game of the present invention is preparing or shuffling a deck of cards, represented at block 40, by activating the shuffling machine 32 or by hand-shuffling a deck to provide a shuffled deck. Next, the players place the initial wager, block 42, by putting equal amounts in each of the three betting areas 22*a, b, c*. Two of the parts of this initial wager, the parts placed in wagering area 22*a* and 22*b* are retrievable at the option of the player. The third portion placed in area 22*c* is a nonwithdrawable bet. After the placing of the wager by each player, the cards are dealt, block 44, three cards being dealt down to each player and two cards are dealt down in front of the dealer. The players inspect or "sweat" their cards in preparation for reaching decision block 46. At decision block 46, the players are queried by the dealer about whether the first part of the initial wager, the part placed in wagering area 22*a*, should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then decide whether to let the second part of the initial wager ride or whether to withdraw it from the game. After each player is queried and decides what to do with regard to the second part of the bet, and those bets to be withdrawn are physically removed from area 22*b* and returned to the player, the dealer reveals the second common down card, as represented at block 52. Each player now has a five card hand comprised of the three cards each player was originally dealt plus the two revealed common cards. The third bet, the bet placed at wagering area 22*c*, is a nonretrievable portion of the initial bet and the flow of the game proceeds to block 54 wherein the players show or reveal their three cards to the dealer. The dealer resolves each player's bet (which includes all three parts, the second and third part or only the third part, depending on the player's choices during play of the hand) based on the five card hand at block 56 and determines what payout, if any, the player is entitled to receive according to the payout schedule at the particular gaming table or casino. Bets on non-winning hands are collected by the dealer or house. The hand is then over and the flow of the game returns to block 40, preparing and shuffling the deck for a new hand.

The award or payoff is given for each of the optional bets that were allowed to ride to the end of the hand and for the nonwithdrawable part of the bet. A typical pay table would be as follows:

| | | |
|---|---|---|
| Pair, Tens or Better | 1–1 | (even money) |
| Two Pairs | 2–1 | |
| Three of a Kind | 3–1 | |
| Straight | 5–1 | |
| Flush | 8–1 | |
| Full House | 11–1 | |
| Four of a Kind | 50–1 | |
| Straight Flush | 200–1 | |
| Royal Flush | 1,000–1 | |

The method of the present invention is not limited to five card poker games, but may be applied or used in other appropriate games such as seven card poker, dice games, wheel games, slot games, video games, live games, computerized or mechanical games. The method of the present invention does not require a shuffling machine 32, dealing module (not shown) or a display means 36. However, these facilitate and expedite the play of a card game as well as add interest to the game. While the initial wager of the present invention is preferably comprised of three equal bets, the bets do not necessarily have to be equal. While equal bets are essential for casino play, unequal bets may be used in home play, if desired. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, club or casino use may also be provided for practicing the method of the present invention.

Another embodiment of the present invention is a modification of a gaming table incorporating a plurality of slot reels as shown in Lowden U.S. Pat. No. 5,630,586, the content which is hereby incorporated by reference.

Figure 3:
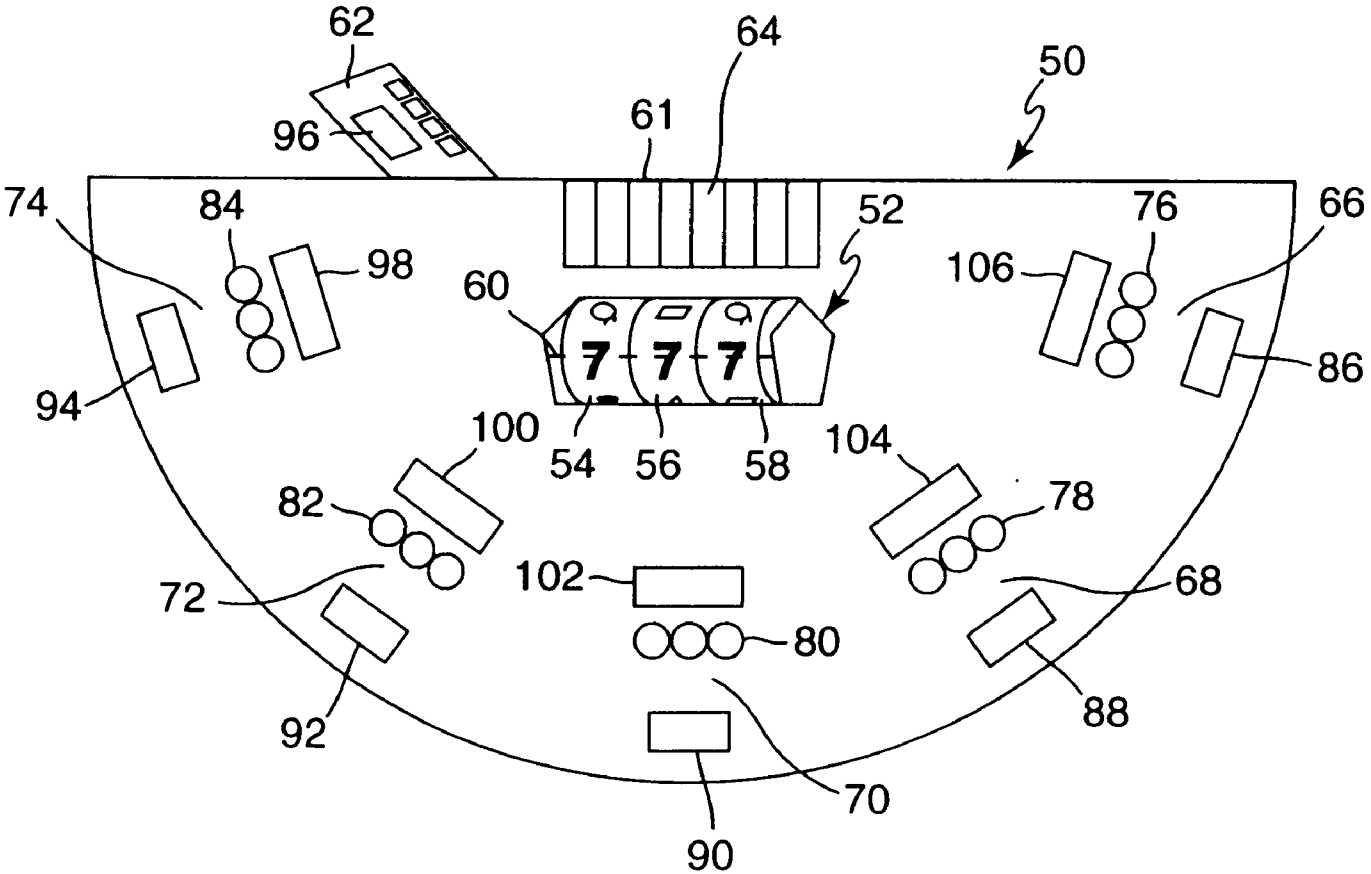
FIG. 3 is a plan view of a gaming table according to the present invention.

As shown in FIG. 3, a gaming table 50 is equipped with an electromechanical reel spinning device 52. The reel spinning device 52 preferably includes three reels 54, 56 and 58, and a single pay line 60. The table also includes a dealer station 61, dealer controls 62, a coin tray 64 and five player stations 66, 68, 70, 72 and 74. Each player station includes a set of three betting circles 76, 78, 80, 82 and 84, and a stop button 86, 88, 90, 92 and 94.

According to the apparatus of the present invention, the reel spinning device 52 is controlled by a game computer (not shown). Each reel begins to spin in response to the dealer depressing the spin button 96 on the dealer controls 62. A random number generator is employed to select the symbol which is displayed on the first reel 54 on the pay line 60. The two remaining reels 56 and 58 continue to spin.

Printed on the table surface is a pay table 98, 100, 102, 104 and 106 located at each player station 74, 72, 70, 68 and 66, respectively. Based on the winning outcomes printed on the pay table and the partial outcome shown on the first reel, the player is given the opportunity to withdraw one of the three bets. One of the players is asked to press the stop button. For example, the player at station 66 depresses the stop button 86. The computer utilizes a random number generator to select the symbol, and causes the symbol to appear on the second reel 56 on the pay line 60. The game computer then sends a signal to the breaking device (not shown) to stop the reel at the selected angular position.

The player is given the opportunity to compare the partial information (e.g.-two of the three reel outcomes) and withdraw a second portion of his bet. Another player is then asked to press the stop button, stopping the third reel. At this point, each player has at least one bet remaining, and all wagers are then resolved. Because each player shares the same outcome, all players either win or lose the round of play as a group. The pay table could be constructed to award players higher proportional payouts for leaving more portions of their bets at risk, or can pay the same proportional payout for a given outcome regardless of the number of bets remaining at the conclusion of play.

Although this illustrated embodiment describes an electromechanical three reel slot table game, the invention contemplates the use of fewer than three or more than three reels, the use of a video screen to simulate reels, or the use of a video screen embedded into a gaming table for the purpose of providing a virtual display of almost any type of known wagering game, including but not limited to card games, dice games, wheel spinning games and the like.

The present invention may be embodied in other specific forms without departing from the essential attributes thereof. It is desired that the embodiments described above may be considered in all respects as illustrative, not restrictive, reference being made to the appended claims to indicate the scope of the invention.

What is claimed is:

1. A method of playing a wagering game comprising a player placing a wager comprising at least two distinct parts and providing to the player at least a portion of the player's game elements so that partial information or a game outcome is provided, giving the player at least one opportunity, before the player's final game outcome is determined, to withdraw from engagement in the game at least one part of said at least two parts, but less than all of said at least two parts, and continuing play of the game with additional portions of the player's game elements being displayed to the player.

2. A method of playing a wagering game comprising a player placing a wager comprising at least two distinct parts and providing to the player a view of at least a portion of a dealer's game elements so that a partial game outcome is provided, giving the player at least one opportunity, before the display of all of the player's and/or the dealer's final game elements are provided, to withdraw from engagement in the game at least one part of said at least two parts, but less than all of said at least two parts, and continuing play of the game to a resolution of remaining wagers.

3. The method of claim 1 wherein said game comprises a casino table card game and the game elements comprise cards.

4. The method of claim 2 wherein said game comprises a casino table card game and the game elements comprise cards.

5. The method of claim 1 wherein said game comprises a video card game.

6. The method of claim 2 wherein said game comprises a video card game.

7. The method of claim 3 wherein said card game comprises a poker game.

8. The method of claim 4 wherein said card game comprises a poker game.

9. The method of claim 5 wherein said video card game comprises a poker game.

10. The method of claim 3 wherein awards are made for predetermined ranks of hands in the card game.

11. The method of claim 5 wherein awards are made for predetermined ranks of hands in the card game.

12. The method of claim 4 wherein awards are made for a player having a higher ranked hand than a dealer in the card game.

13. The method of claim 8 wherein awards are made for a player having a higher ranked hand than a dealer in the card game.

14. The method of claim 5 wherein awards are made for a player having a higher ranked hand than a dealer in the card game.

15. The method of claim 6 wherein awards are made for a player having a higher ranked hand than a dealer in the card game.

16. The method of claim 6 wherein awards are made for predetermined ranks of hands in the card game.

17. The method according to claim 3, wherein each of said at least two parts of said wager are equal.

18. The method according to claim 4, wherein each of said at least two parts of said wager are equal.

19. The method according to claim 3, wherein each of said at least two parts of said wager are unequal.

20. The method according to claim 4, wherein each of said at least two parts of said wager are unequal.

21. The method according to claim 4 wherein said at least two parts comprises at least three parts.

22. The method of claim 5 wherein each of said at least two parts of said wager are equal.

23. The method of claim 6 wherein each of said at least two parts of said wager are equal.

24. The method of claim 5 wherein each of said at least two parts of said wager are unequal.

25. The method of claim 6 wherein each of said at least two parts of said wager are unequal.

26. The method according to claim 5 wherein said at least two parts comprises at least three parts.

27. The method according to claim 6 wherein said at least two parts comprises at least three parts.

28. The method according to claim 21 wherein said at least two parts comprises at least three parts.

29. The method according to claim 22, wherein an initial three-part wager amount wagered by each participating player comprises three equal parts and is wagered before any cards are dealt.

30. A betting method for a live casino card game comprising:

a player placing a wager to participate in a live casino game, the wager comprising at least two parts;

a dealer dealing at least a partial hand to the player;

the player examining the at least a partial hand and optionally withdrawing at least one of said at least two parts, but less than all of said at least two parts of the wager;

the dealer dealing at least one additional card to the at least a partial hand of the player to complete the player's hand; and the dealer making payouts to the player holding a winning hand, wherein the winning hand is determined by rules of the live casino card game.

31. A betting method for a live casino card game comprising:

a player placing a wager to participate in a live casino game, the wager comprising at least two parts;

a dealer dealing at least one group comprising:

a) a partial hand of cards to the player and b) at least one common card which forms part of each players' hand;

the player examining the at least one group and, based upon partial information, optionally withdrawing at least one of said at least two parts, but less than all of said at least two parts of the wager;

the dealer dealing at least one additional card to the common cards or to the partial hand of the player and playing the game to a conclusion; and the dealer making payouts to the player or players holding a winning hand, wherein the winning hand is determined by rules for the live casino card game.

32. A betting method for a gaming machine comprising:

a player placing a wager to participate in a casino machine wagering game comprising a plurality of game elements, the wager comprising at least two parts;

activating the wagering game;

revealing at least a portion of the game elements to the player on a player display; the player optionally withdrawing at least one of said at least two parts, but less than all of said at least two parts of the wager based upon consideration of the revealed game elements;

concluding play of the casino machine wagering game; and awarding payouts to the player for a winning combination of game elements, wherein the winning outcome is determined by rules for the casino machine wagering game.

33. A betting method for a live casino game comprising a plurality of game elements, the live casino game having rules that provide that a portion of the game elements is revealed to the player prior to the conclusion of the game, wherein the game includes a dealer, the method comprising:

a player placing a wager to participate in the casino game, the wager having at least two parts;

the dealer initiating the game, wherein a portion of the game elements is revealed to the player;

the player examines the revealed portion of the game and optionally withdraws a portion of said at least two parts, but less than all parts of said wager;

completing the play of the game; and the dealer awarding payouts to a player or players having a combination of game elements that results in a winning outcome, wherein the winning outcome is defined by rules of the live casino game.

34. A gaming apparatus for playing a live casino wagering game, comprising:

a gaming table including:

a playing surface;

a plurality of player locations on the playing surface;

a dealer station;

dealer game controls;

a chip tray mounted into the playing surface;

a plurality of betting areas located at each player location, wherein each player is required to place a bet comprising a plurality of parts;

a reel slot display;

a game computer for controlling the operation of the game; and player controls located at each player location, wherein the player controls permit a player to stop less than all the reels from spinning to afford the player an opportunity to withdraw fewer than all parts of his bet before the last wheel comes to rest.

35. The apparatus of claim 34 wherein the bet is a three part bet, and the reel mechanism is a three reel mechanism, wherein the player is permitted to withdraw one portion of the bet after the first reel stops spinning.

36. The apparatus of claim 34, wherein the player is permitted to withdraw a second portion of his bet after the second reel stops spinning.

37. The apparatus of claim 34, wherein the reel slot display is an electromechanical reel slot display.

38. The apparatus of claim 34, wherein the reel slot display is a video reel display.

39. A method of playing a slot-type casino wagering game comprising:

a player placing a wager of at least two distinct parts to participate in the game;

revealing to the player at least one slot symbol defining a partial game outcome to the player;

providing the player the opportunity to withdraw at least one part, but fewer than all parts of his wager based on the revealed slot symbol;

revealing to the player the remaining slot symbols defining the game outcome; and paying the player an award for a predetermined winning outcome, wherein the amount of the award is based on the parts of the wager remaining in play.

40. The method of claim 39, wherein the wager comprises three equal parts, and the game is a three reel slot device.

41. The method of claim 40, wherein the game is a live casino table game.

42. The method of claim 40, wherein the player is provided with a second opportunity to withdraw at least one part of his bet.

43. A method of playing a wagering game comprising the steps of:

placing a wager, beginning the game, giving the player an opportunity to withdraw a portion of the wager, continuing the game until its outcome and resolving the remaining part of the wager.

44. A method of playing a wagering game comprising the steps of:

placing a wager to become a player, providing at least one card to a player, providing the player an opportunity to examine the at least one provided card and withdraw only a part of the wager and leave a remaining part of the wager, providing at least one additional card to the player, and resolving the remaining part of the wager.

45. A method of playing a wagering game comprising the steps of:

placing a wager to become a player, providing at least one card to a player, providing the player an opportunity to examine the at least one provided card and withdraw at least a part of the wager and leave a remaining part of the wager, providing at least one additional card to the player, and resolving the remaining part of the wager.

46. The method according to claim 45 wherein the game comprises a casino game between a casino and a plurality of players.

47. The method according to claim 45 wherein the cards are standard playing cards.

48. The method according to claim 45 wherein the wager is divided into a number of parts and the at least one additional card comprises a number of cards, and wherein the number of parts of the wager that may be withdrawn is equal to the number of said at least one additional cards.

* * * * *

UNITED STATES PATENT AND TRADEMARK OFFICE

CERTIFICATE OF CORRECTION

PATENT NO. : 6,273,424 B1
DATED : August 14, 2001
INVENTOR(S) : John G. Breeding It is certified that error appears in the above-identified patent and that said Letters Patent is hereby corrected as shown below:

Title page,
Item [73], Assignee, please insert -- [73] Assignee: Shuffle Master, Inc., Eden Prairie, MN (US) --
Item [63], Related U.S. Application Data, please replace original text with the following:
-- This application is a continuation-in-part of co-pending Application No. 08/970,966, filed November 14, 1997, now US Patent No. 6,019,374, which a continuation of US Application No. 08/695,640, filed August 12, 1996, now abandoned, which is a continuation-in-part of US Patent Application No. 08/388,292, filed February 14, 1995, now US Patent No. 5,544,892, which is a continuation-in-part of US Patent Application No. 08/043,413, filed April 6, 1993, now US Patent No. 5,417,430, which is a continuation-in-part of US Patent Application No. 08/023,196, filed February 25, 1993, now US Patent No. 5,288,081. --

Column 1,
Lines 5-12, RELATED APPLICATIONS, please replace original text with the following:
-- This application is a continuation-in-part of co-pending Application No. 08/970,966, filed November 14, 1997, now US Patent No. 6,019,374, which a continuation of US Application No. 08/695,640, filed August 12, 1996, now abandoned, which is a continuation-in-part of US Patent Application No. 08/388,292, filed February 14, 1995, now US Patent No. 5,544,892, which is a continuation-in-part of US Patent Application No. 08/043,413, filed April 6, 1993, now US Patent No. 5,417,430, which is a continuation-in-part of US Patent Application No. 08/023,196, filed February 25, 1993, now US Patent No. 5,288,081. --

Signed and Sealed this

Thirteenth Day of July, 2004

JON W. DUDAS
*Acting Director of the United States Patent and Trademark Office*